United States Patent [19]

Schick

[11] 4,129,216

[45] Dec. 12, 1978

[54] DISPLAY STAND FOR SEWING-THREAD SPOOLS AND LIKE ARTICLES

[75] Inventor: Henri Schick, Paris, France

[73] Assignee: Promotion Etude Conditionnement d'Articles de Mercerie - PECAM Internat., Orly, France

[21] Appl. No.: 803,417

[22] Filed: Jun. 3, 1977

[30] Foreign Application Priority Data

Jun. 11, 1976 [FR] France ..... 76 17739

[51] Int. Cl.[2] ..... A47F 7/16

[52] U.S. Cl. ..... 211/13; 211/135; 242/139

[58] Field of Search ..... 211/13, 135, 144, 72, 211/78, 59.1, 131; 242/139; 206/391, 392

[56] References Cited

U.S. PATENT DOCUMENTS

| | | | |
|---|---|---|---|
| 1,893,419 | 1/1933 | Kulzer | 242/139 |
| 2,330,702 | 9/1943 | Goldschmidt | 242/139 |
| 2,380,117 | 7/1945 | Maldonado | 211/13 |
| 2,679,341 | 5/1954 | Tinker | 211/78 X |
| 3,392,827 | 7/1968 | Bogren | 206/392 |
| 3,464,648 | 9/1969 | Fuhriman | 242/139 |
| 3,552,669 | 1/1971 | Earnest | 242/139 X |
| 4,033,455 | 7/1977 | Robison | 206/391 |

*Primary Examiner*—James T. McCall
*Assistant Examiner*—Robert W. Gibson, Jr.
*Attorney, Agent, or Firm*—Michael J. Striker

[57] ABSTRACT

This display stand, of the rack or the revolving-stand type, for sewing-thread spools or like articles, comprises a plurality of superposed shelves or trays each provided with projections adapted to engage the central cavity of a hub of a relatively large spool constituting a support for either a plurality of other, smaller spools on which the product to be displayed is wound, or a plurality of small boxes containing the articles to be displayed, the shelves or trays consisting of resiliently deformable material, said support also comprising projections engageable in the hub cavities of said smaller spools or boxes, the latter being adapted to be removed from said relatively large support-forming spool, and the latter from said shelves or trays, by momentarily altering the shape of said supports or shelves or trays, respectively.

10 Claims, 7 Drawing Figures

DISPLAY STAND FOR SEWING-THREAD SPOOLS AND LIKE ARTICLES

BACKGROUND OF THE INVENTION

Field of the Invention

This invention is directed to provide an improved display stand or like device adapted to display in an original and attractive manner sewing-thread spools or bobbins, or other reels or similar or different articles.

SUMMARY OF THE INVENTION

This display stand is intended more particularly for receiving detachable supports each adapted to carry several articles for sale or display, such as sewing-thread spools or small round boxes containing articles of relatively small dimensions, each support having substantially the shape of a large spool capable of receiving a series of sewing-thread spools or other articles for sale. The flanges of these spool-shaped supports are made from a suitable flexible or elastically deformable material and comprise on their inner surfaces projections adapted to engage the axial cavity of each spool disposed on this support about a central hub thereof. Thus, the thread spools or like articles can easily be fitted on the support. In its loaded condition, this support will thus assume the configuration of a turret from which any desired thread-spool or other similar article carried thereby can be removed when necessary.

The display stand according to this invention is adapted to assemble in a most attractive manner a series of supports of the kind broadly disclosed hereinabove for displaying the corresponding articles for sale at any desired and suitable location. This display stand may also be arranged to permit the easy removal of said supports for substituting other supports therefor, while protecting said supports from theft.

For this purpose, the display stand according to this invention assumes the configuration of a rack or set of shelves of which the various superposed shelves comprise each a series of projections disposed at spaced intervals along their length and of such diameter that they can be engaged into the cavities of the hubs of a plurality of spool-shaped supports to constitute efficient pivot and retaining means therefor.

According to another feature characterizing this invention, the shelves of this display stand consist of deformable material and the relative spacing between any pair of superposed shelves is only very slightly greater than the height of a turret-like support, whereby the latter can be disengaged from said projections acting as pivot and retaining means only when said shelves are momentarily distorted.

However, other features and advantages of the display stand according to this invention will appear as the following description proceeds with reference to the attached drawing.

DESCRIPTION OF THE PREFERRED EMBODIMENTS

Figure 1:
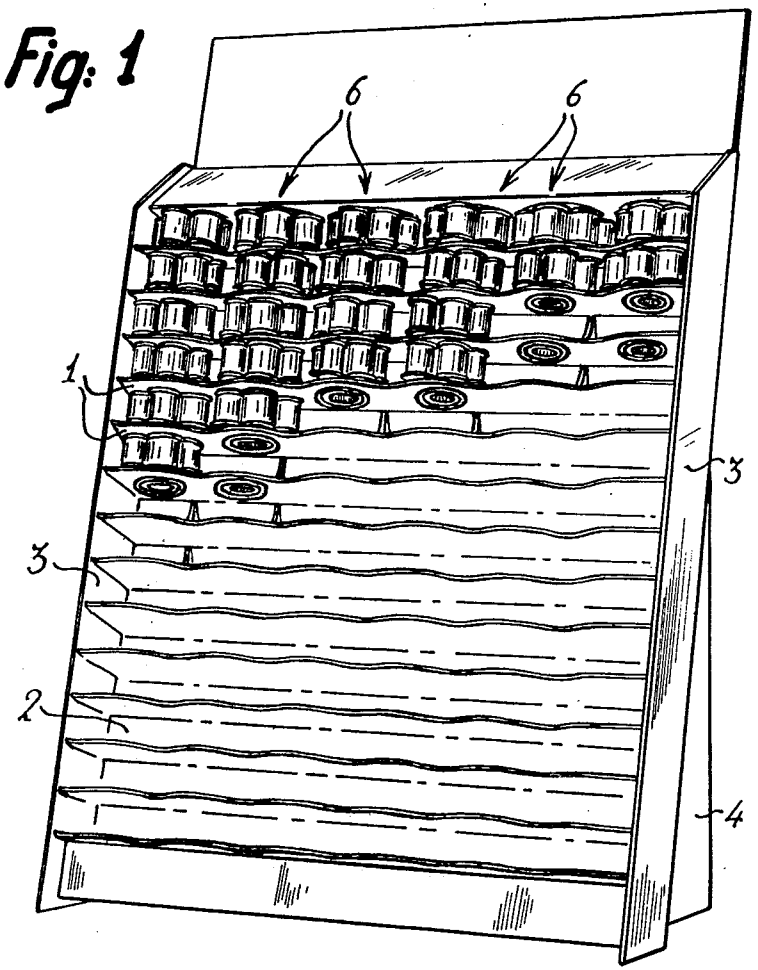
FIG. 1 is a perspective view showing a first form of embodiment of the rack-shaped display stand according to this invention.
Figure 3:
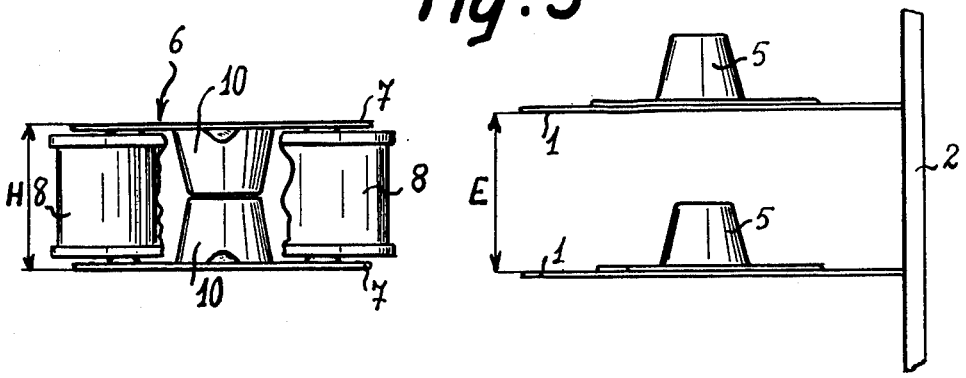
FIGS. 3 and 4 are fragmentary side elevational views illustrating the manner in which said turret-like supports are fitted into the display rack of FIG. 1.

The display device illustrated in FIG. 1 is of the rack type and comprises a set of horizontal superposed shelves 1. Each shelf 1 comprises a strip of deformable material and the various shelf-forming strips are secured to a frame structure comprising a bottom plate 2 and a pair of lateral wings 3. On its rear side this rack comprises a pair of spaced supporting easels 4, preferably hingedly mounted on the back of the device, only one of them being visible in FIG. 1.

Each shelf 1 comprises a series of projections 5 disposed at spaced intervals therealong. Preferably, the shelves 1 are made from a suitable thermoplastic material and the projections 5 formed thereon are obtained through a single thermo-shaping operation. The purpose of these projections 5 is to act as pivot and retaining members to as many turret-shaped supports 6 each adapted to carry in turn a plurality of articles displayed for sale or other purposes.

Figure 2:
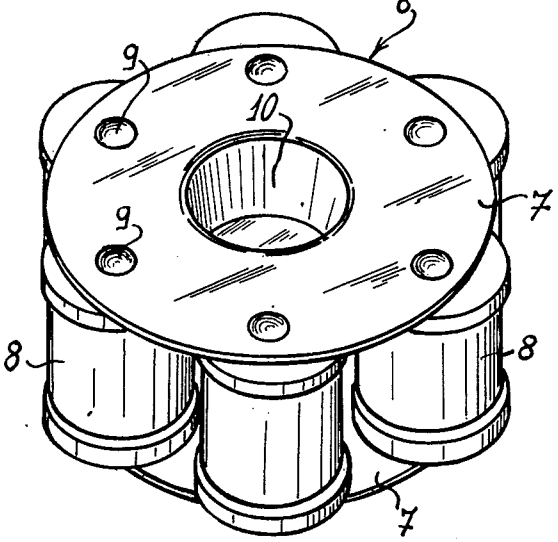
FIG. 2 is a perspective view showing on a larger scale one of the turret-shaped supports adapted to be inserted in the rack-type display stand of FIG. 1.

One of these turret-shaped supports 6 is shown on a larger scale in FIG. 2. More particularly, this support 6 has substantially the configuration of a spool of relatively large diameter having disposed between its two flanges 7 a series of sewing-thread spools 8 or similar articles to be displayed. These spools 8 are disposed at spaced angular intervals around the central hub of the relevant support 6 and retained in position by projections 9 formed on the inner surfaces of said flanges 7 and each adapted snappily to engage the axial cavity of a spool. The flanges 7 are made of resiliently deformable material to permit the easy fitting and removal of the various sewing-thread spools, for example small boxes containing the products to be displayed for sale, in the case of relatively small articles.

As clearly apparent in FIG. 2, the central hub of each support 6 may consist of a pair of studs 10 projecting from the inner surface of both corresponding flanges 7. These studs are hollow and thus provide each a central cavity in either of the two flanges.

Now, the diameter and shape of the projections 5 formed on the shelves 1 of the display device are such that each projection can engage one of the cavities thus provided. Therefore, each projection is capable of acting as a retaining means for one of said supports 6. However, said projections may also act at the same time as pivot means to the corresponding support.

According to an essential feature characterizing this invention the gap E provided between two adjacent superposed shelves 1 is only very slightly greater than the height H of supports 6. Under these conditions, when the supports 6 fitted in position it is not possible to remove them stealthily.

Figure 4:
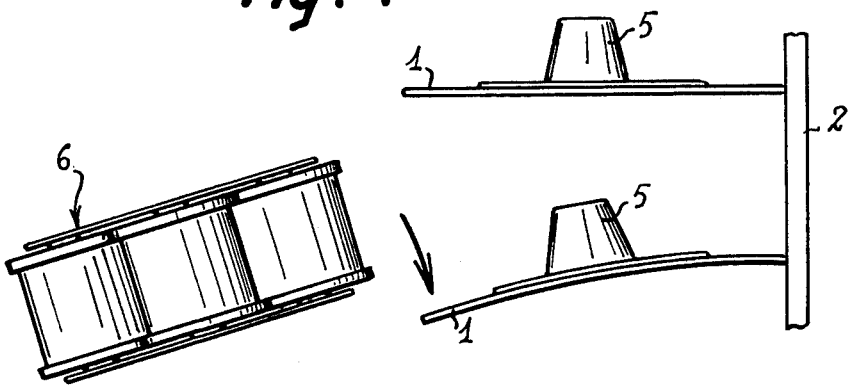
Figure 5:
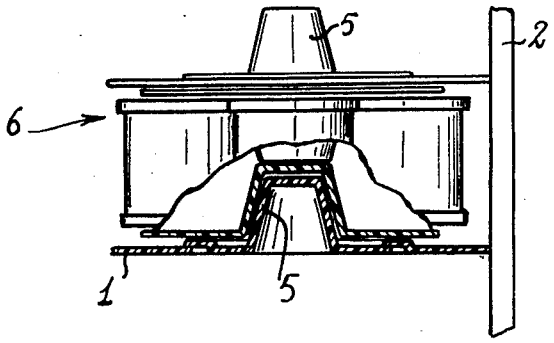
FIG. 5 is a side-elevational view with parts broken away, showing the same support fitted in position.

In any case, as mentioned in the foregoing, these shelves 1 are made of resiliently deformable plastic material. Thus, the supports 6 can be fitted in position by momentarily altering the shape of one of the corresponding shelves, as clearly illustrated in FIG. 4. In this case, this support 6 can be presented above the projecting stud 5 of one of the shelves for eventually engaging this projecting stud into the hub cavity of the support, as illustrated in FIG. 5.

Thus, the support 5 is safely held in position on the display stand and cannot be stealthily removed therefrom. In fact, this support can only be removed through a particular operation consisting in momentarily distorting again the corresponding shelf.

As mentioned hereinabove, the projecting studs 5 of shelves 1 are effective not only for retaining the supports 6 in position but also as pivot means thereto. Thus, when a plurality of spools 2 have been removed from one of said turret-shaped supports 6, the latter can be rotated about its axis to bring another spool carried thereby to the front, so that this other spool can be removed in turn.

Due to its specific arrangement, this display stand permits of presenting in a particularly attractive manner a complete range of sewing-thread spools or a series of spools containing any other desired products for sale, such as adhesive-tape reels, etc. However, this display stand is also advantageous notably in shops and other sales premises since a relatively great number of spools containing sewing-threads of different colours and characteristics can be assembled in a relatively limited space or volume. Besides, the replacement of spool supports such as 6 is greatly facilitated. In fact, when all the spools carried by a same support have been sold or removed, this support is simply replaced by another support filled with new spools or other articles to be displayed for sale or other purposes.

Of course, the number of shelves incorporated in the display stand of this invention is a matter of choice, this also applying to the relative arrangement of the shelves themselves. On the other hand, this display device may also be manufactured from any other elastically deformable material outside plastic material, such as pressed sheet-metal.

Furthermore, as suggested in the foregoing, the display device illustrated in FIGS. 1 to 5 of the drawing may also receive spools carrying other articles or materials such as adhesive tape, electric fuse wire, etc. in lieu of the sewing-thread mentioned hereinabove. Besides, small boxes containing miscellaneous articles to be displayed for sale, such as screws, bolts, washers, nails, rivets, etc. may be substituted for the spools mentioned hereinabove.

Figure 6:
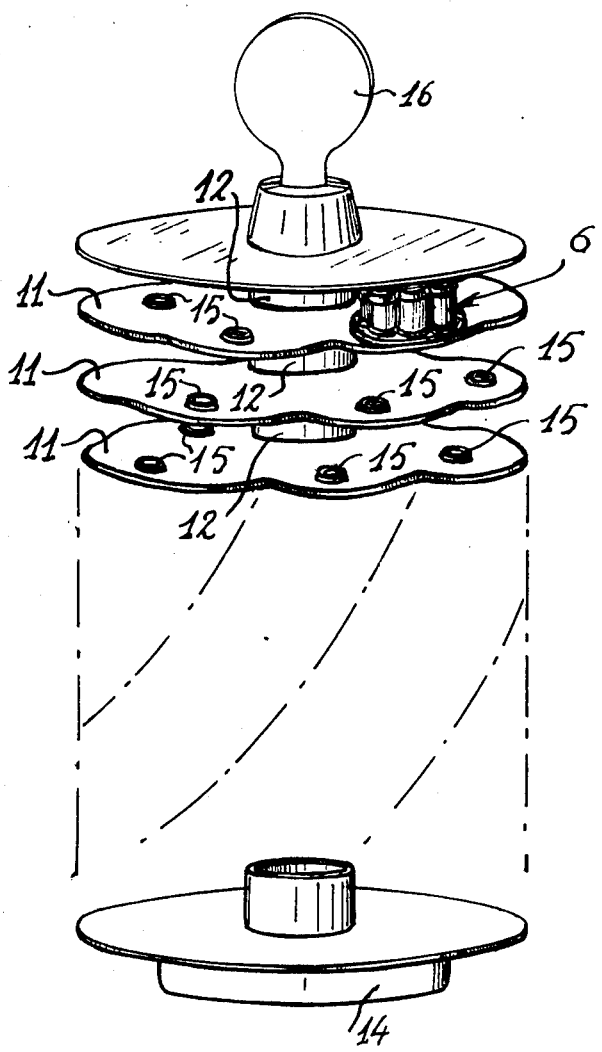
FIG. 6 is a perspective view of another embodiment of the display device of this invention, in the form of a revolving stand.
Figure 7:
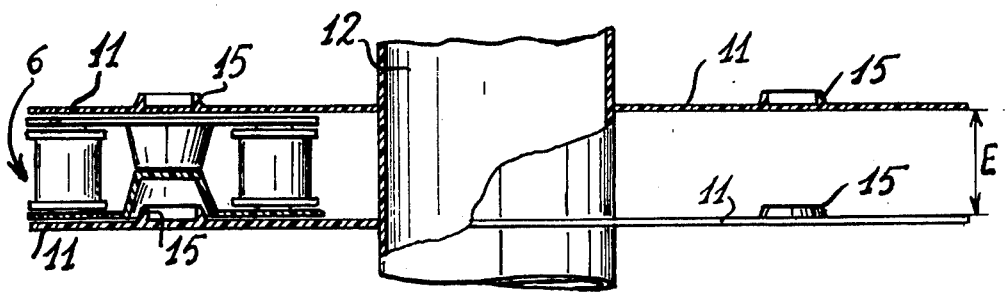
FIG. 7 is a fragmentary sectional view of part of this display device.

FIGS. 6 and 7 of the drawing illustrate another possible form of embodiment of the display device of this invention. In this case, the device consists of a revolving stand comprising a series of superposed horizontal trays 11 rigid with a vertical central column 12. These horizontal trays 11 are somewhat substituted for the rectilinear shelves 1 of the display rack illustrated in FIG. 1. In fact, each tray 11 has formed on its upper surface a series of spaced projections or studs 15 adapted to serve the same purpose as the projecting studs 5 of the shelves of the display rack of FIG. 1. These studs 15 are disposed at spaced angular intervals on a common circle concentric with said central column 12. Thus, a plurality of detachable turret-like supports 6 can be inserted between any pair of adjacent superposed trays 11, so that these supports 6 are disposed concentrically to said central column 12.

As in the preceding form of embodiment shown in FIGS. 1 to 5, the superposed shelves of said trays 11 are made of a suitable resiliently deformable plastic material, and the gap or distance E existing between any pair of adjacent trays 11 is only slightly greater than the height H of supports 6. Under these conditions, these supports are fitted in position by applying the same procedure as for the preceding embodiment.

Preferably, the central column 12 is rotatably mounted on a bottom base member 14, so that the stand can be rotated about its vertical axis. Besides, this revolving stand can easily be provided at its top with a show card 16 on which a trade mark or name, or advertising information, is reproduced.

What is claimed as new is:

1. A stand, particularly a display stand, comprising a housing having at least two elongated shelves parallel to each other and spaced from each other in direction normal to the elongation of said shelves and thereby defining a space between each other; a plurality of supports rotatably and detachably received in the space between the shelves for rotation about respective first axes normal to the elongation of said shelves; a plurality of members rotatably and detachably mounted on each of said supports, for rotation about respective second axes parallel to said first axes and normal to said elongation of said shelves; first means for detachably installing each of said supports in the space between the shelves; and second means for detachably installing each of said members on said supports.

2. A stand as defined in claim 1, wherein each of said supports includes two plates parallel to each other and spaced from each other, so as to define a space between said plates, each of said plates having a first surface directed inwardly towards the other plate and a second surface directed outwardly away from the other plate.

3. A stand as defined in claim 2, wherein said first means include a plurality of projections provided on said shelves longitudinally along the elongation of the shelves and spaced from each other, each of said second surfaces of the supports is provided with a recess having an opening outwardly away from the other plate and corresponding to said projections on the shelves.

4. A stand as defined in claim 3, wherein said recesses are of a circular cross-section having an axis coaxial with the corresponding first axis of the support.

5. A stand as defined in claim 4, wherein said shelves are of flexible material and due to their flexibility permitting installation of the supports in and their removal from said space upon elastic deformation of said shelves in a direction away from each other so as to respectively permit entering and withdrawal of said projections provided on said shelves from said recesses provided on said second surfaces of the supports.

6. A stand as defined in claim 2, wherein said second means include a plurality of projections provided on said first surfaces of the plates, said projections being circumferentially spaced from each other, so that each projection of the first surface of one plate faces a corresponding projection provided on the other plate.

7. A stand as defined in claim 6, wherein each of members has a first end face provided with a first recess corresponding to a projection provided on the first surface of the one plate, a second end face provided with a second recess corresponding to a projection provided on the other plate.

8. A stand as defined in claim 7, wherein said plates are of flexible material and due to their flexibility permitting installation of the members in and their removal from said space between said plates upon elastic deformation of said plates in a direction away from each other so as to respectively permit entering and withdrawal of said projections provided on the first surfaces of the plates from the recesses provided on the end faces of the members.

9. A stand as defined in claim 3, wherein said shelves are of thermoplastic material integrally connected with said thermoshaped projections.

10. A stand, particularly a display stand, comprising a housing having at least two elongated flexible shelves parallel to each other and spaced from each other in a direction normal to the elongation of said shelves and thereby defining a space between each other of a first predetermined width; a plurality of supports rotatably and detachably received in the space between said shelves for rotation about respective axes normal to the elongation of said shelves, said supports being of a second predetermined width slightly less than the first predetermined width to thereby insure close receiving of said supports in the space between said shelves; and means including projections on said shelves extending partly across said space and recesses in the supports for detachably installing said supports in the space between said shelves, said shelves due to their flexibility permitting installation of the supports in and their removal from said space upon elastic deformation of said shelves in a direction away from each other so as to respectively permit entering and withdrawal of said projections from said recesses.

* * * * *